US008151910B2

(12) United States Patent
Swinford

(10) Patent No.: US 8,151,910 B2
(45) Date of Patent: Apr. 10, 2012

(54) DRILLING JAR

(76) Inventor: Jerry L. Swinford, Spring, TX (US)

( * ) Notice: Subject to any disclaimer, the term of this patent is extended or adjusted under 35 U.S.C. 154(b) by 232 days.

(21) Appl. No.: 12/437,525

(22) Filed: May 7, 2009

(65) Prior Publication Data

US 2009/0277690 A1 Nov. 12, 2009

Related U.S. Application Data

(60) Provisional application No. 61/051,204, filed on May 7, 2008, provisional application No. 61/138,877, filed on Dec. 18, 2008.

(51) Int. Cl.
*E21B 4/14* (2006.01)
*E21B 31/113* (2006.01)

(52) U.S. Cl. ..... 175/297; 175/296; 166/178

(58) Field of Classification Search ..... 166/178; 175/296, 297

See application file for complete search history.

(56) References Cited

U.S. PATENT DOCUMENTS 3,429,389 A * 2/1969 Barrington ..... 175/297
5,033,557 A 7/1991 Askew
5,411,107 A 5/1995 Hailey et al.
5,447,196 A * 9/1995 Roberts ..... 166/178
5,495,902 A 3/1996 Hailey et al.
5,906,239 A * 5/1999 Oettli ..... 166/178
6,675,909 B1 1/2004 Cowart et al.

* cited by examiner

*Primary Examiner* — Giovanna Wright
(74) *Attorney, Agent, or Firm* — Keeling Patents and Trademarks, LLC; Melissa M. Martinez

(57) ABSTRACT

A bidirectional drilling jar, capable of repeated unidirectional firing, including a sliding assembly that is disposed in a sliding relation to the interior of a barrel assembly. A portion of the inner diameter of the barrel assembly forms a restricted barrel segment. The restriction intermediate an upper chamber and a lower chamber. A metering system comprising an upper flange a meter valve, and a lower flange. The meter valve slideably disposed on the sliding assembly between the upper and lower flanges. The metering system travels between the upper chamber and the lower chamber providing limited, controlled flow of the fluid contained therein when passing through the restriction in order to pressurize the system and produce a jarring stroke. Alternatively, the metering system comprises an upper flange, a meter ring, a meter valve, and a lower flange. The meter valve and meter ring are slideably disposed on the sliding assembly intermediate the upper and lower flanges.

19 Claims, 8 Drawing Sheets

DRILLING JAR

CROSS-REFERENCE TO RELATED APPLICATIONS

This application claims the benefit of U.S. provisional application Ser. No. 61/051,204 filed on May 7, 2008, and U.S. provisional application Ser. No. 61/138,877 filed on Dec. 18, 2008, which applications are both incorporated herein by reference as if reproduced in full below.

STATEMENT REGARDING FEDERALLY SPONSORED RESEARCH OR DEVELOPMENT

Not Applicable.

BACKGROUND OF THE INVENTION

1. Field of the Invention

The present invention relates in general to jar devices for use during downhole operations. More specifically, the invention is directed to a bidirectional jar for use with coiled tubing.

2. Description of the Related Art

Downhole drilling operations generally require a drill string attached to a surface rig at one end and a drill bit or motor at the opposite end. Generally, a number of tubular sections are attached in succession between the surface rig and the drill bit or motor section. The number and types of tubular sections used varies depending on the circumstances.

During operations a need may arise to retrieve a downhole tool that has been set within the bore or that has become lodged therein, to set or pull tools or plugs, general fishing of downhole retrievables, manipulating tools, unsticking a stuck drill string, etc. Jarring devices are used to address these types of issues by producing upward and/or downward impact forces to act on the object.

BRIEF SUMMARY OF THE INVENTION

An exemplary embodiment of the jar device includes a barrel assembly, a sliding assembly and a metering system. The sliding assembly is positioned in sliding relation to the interior of the barrel assembly to provide the downstroke and/or upstroke of the jar device. A portion of the inner diameter of the barrel assembly forms a restricted barrel segment. The restriction is disposed intermediate an upper chamber and a lower chamber, defining a transition therebetween. The metering system comprises an upper flange, a lower flange, and a meter valve. The meter valve is slideably disposed on the sliding assembly intermediate the upper and lower flanges. The metering system travels between the upper chamber and the lower chamber providing limited, controlled flow of the fluid contained therein when passing through the restriction. At least one opening on the lower flange provides limited flow of the fluid. Similarly, at least one opening on the upper flange provides limited flow of the fluid. The fluid flow is adjustable by, among other things, controlling the size and/or number of the openings.

In the downstroke, the at least one opening on the upper flange limits fluid flow to the upper chamber from the annular space intermediate the meter valve and the sliding assembly. In the upstroke, the at least one opening on the lower flange limits fluid flow to the lower chamber from the annular space intermediate the meter valve and the sliding assembly.

A further exemplary embodiment comprises a metering system that includes an upper flange, a meter ring, a meter valve, and a lower flange. The meter valve and meter ring are slideably disposed on the sliding assembly intermediate the upper and lower flanges. The metering system travels between the upper chamber and the lower chamber providing limited, controlled flow of the fluid contained therein when passing through the restriction. At least one opening on the lower flange provides limited flow of the fluid. Similarly, at least on opening on the meter ring provides limited flow of the fluid. The fluid flow is adjustable by, among other things, controlling the size and/or number of the openings.

Other features and advantages of the invention will be apparent from the following detailed description, the accompanying drawings, and the appended claims.

DETAILED DESCRIPTION OF THE INVENTION

Figure 1:
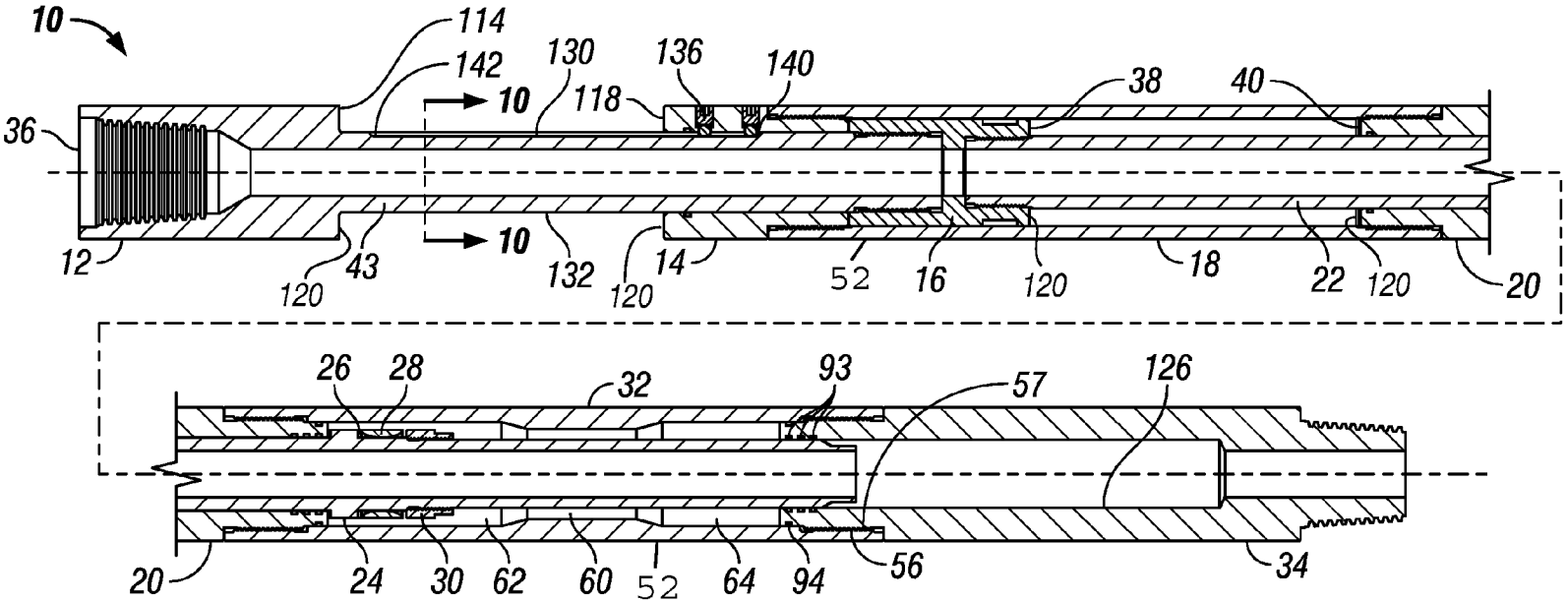
FIG. 1 is a cross-sectional view of an embodiment of the drilling jar in an upstroke orientation.
Figure 4:
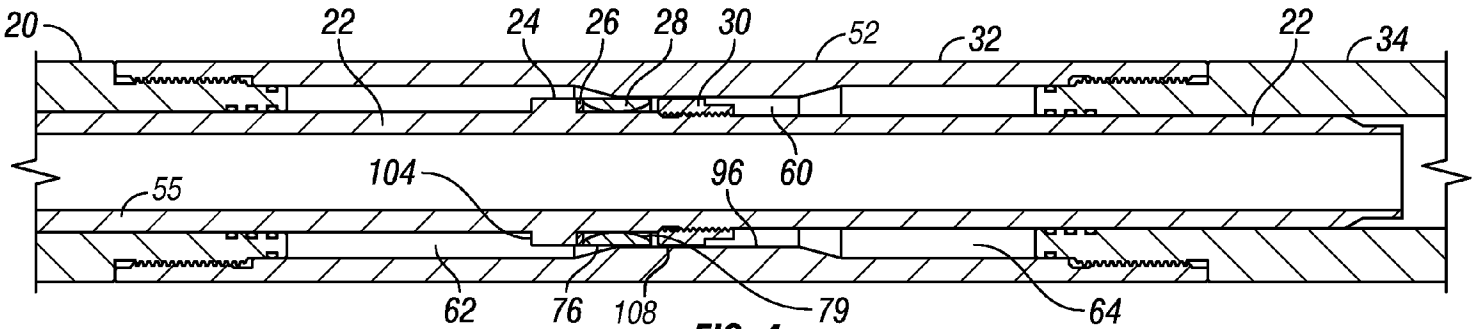
FIG. 4 is a cross-sectional view of the embodiment of FIG. 3 within the restricted barrel segment of the barrel assembly during a downstroke.

Referring to FIGS. 1 and 4, an exemplary embodiment of the drilling jar 10 comprises a sliding assembly 55 that is telescopically disposed within a barrel assembly 52.

It is understood that the terms "upper" and "lower" as used herein are for ease of reference only, and that the tool has utility both in vertical and in laterally or horizontal wellbores. Thus, "upper" refers to the direction of the upper end 36 of the upper mandrel 12 that connects, either directly or indirectly, to a drill string or tubing (not shown), while "lower" refers to the direction of the lower sub 34.

The sliding assembly 55 generally includes an upper mandrel 12, a knocker 16 and a wash pipe 22 having upper flange 24. It is understood that the upper flange 24 may be affixed to the sliding assembly 55 by any known means. Further, the upper flange 24 may be integrally attached to the sliding assembly 55. The sliding assembly 55 is slideable in relation to the barrel assembly 52. The barrel assembly 52 generally includes an upper sub 14, an upper barrel 18, a center sub 20, a lower barrel 32 and a lower sub 34. A meter assembly 66 is disposed intermediate the lower barrel 32 and the wash pipe 22. The meter assembly 66 generally includes a meter ring 26, a meter valve 28, and a lower flange 30.

Figure 1A:
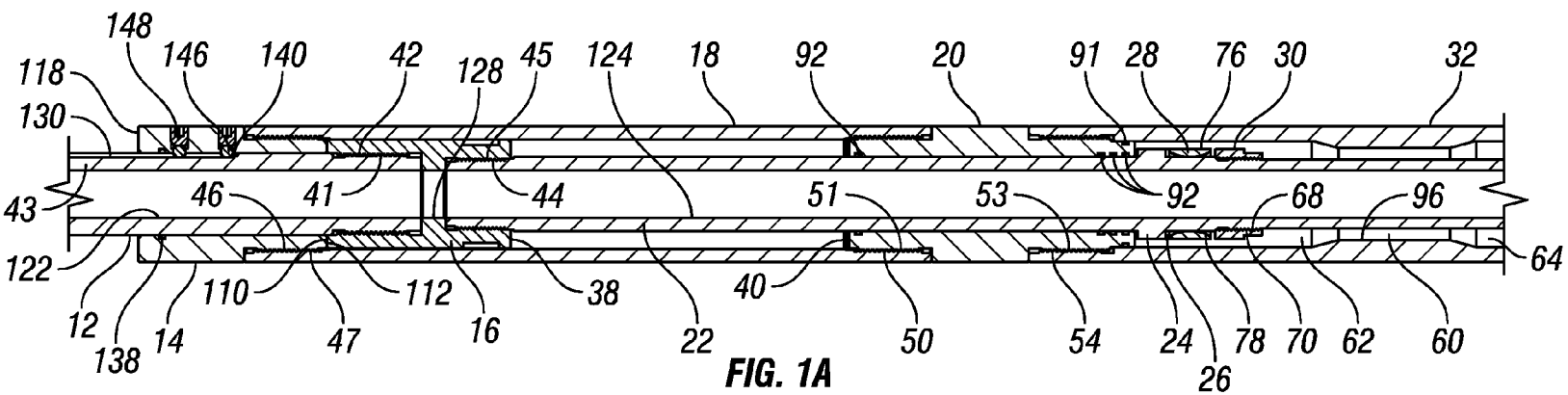
FIG. 1A is a detailed view of a portion of FIG. 1.
Figure 2:
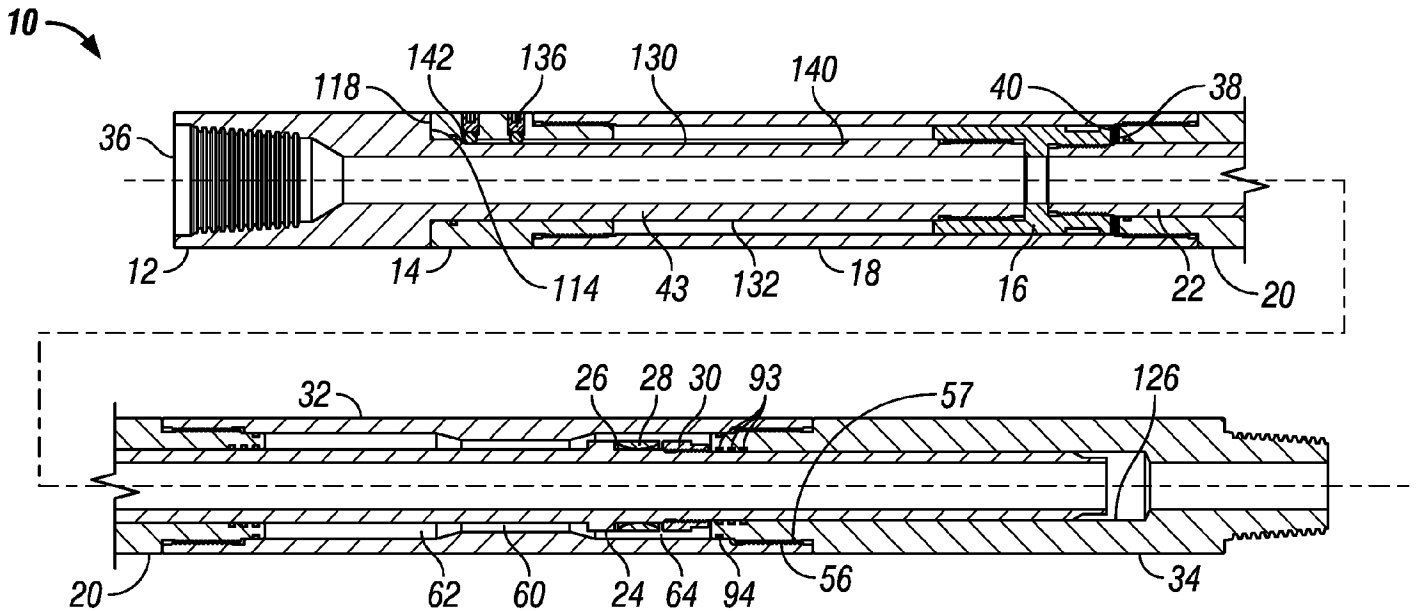
FIG. 2 is a cross-sectional view of an embodiment of the drilling jar in a downstroke orientation.

Referring to FIGS. 1, 1A, 2 and 2A, in operation, the exemplary embodiment of the drilling jar 10 is either directly or indirectly attached to a drill string or tube (not shown). Assuming an initial orientation as shown in FIG. 1, upon initiation of the downstroke, the mandrel 12 and corresponding sliding assembly 55 move downward linearly in relation to barrel assembly 52. Such movement is purposefully slowed by the meter assembly 66 allowing energy to build within the system such that the force will be released once the metering process is complete. The release results in a collision of the lower end 38 of the knocker 16 with the shoulder 40 of the center sub 20. Such movement may further result in collision of shoulder 114 of mandrel 12 with upper sub 14, as seen in FIG. 2. The collision results in a jarring impact. Such jarring impact is thus transferred to the barrel assembly 52 and hence to subassemblies (not shown) that may be attached to the lower sub 34.

The drill string may then be raised, pulling sliding assembly 55 upward in relation to barrel assembly 52. Such movement is purposefully slowed by the meter assembly 66 allowing energy to build within the system such that the force will be released once the metering process is complete. The release results in collision of the upper end 110 of the knocker 16 with shoulder 112 of the upper sub 14, as seen in FIG. 1.

Referring to FIGS. 1, 1A, 2, 2A, and 10, the upper mandrel 12 contains a mandrel pipe 43. At least one grooved spline 130 is formed longitudinally along the outside surface 132 of the mandrel pipe 43 such that the spline 130 is substantially parallel to the longitudinal axis of the pipe 43. At least one corresponding male spline member 136 is disposed within the upper sub 14 proximate its free end 118. The male spline member 136 is situated within the groove of the spline 130. The at least one male spline member 136 is movable between a first position 140 and a second position 142 along the spline 130 as necessary for proper operation of the drilling jar 10. A purpose of the coupling of the spline 130 and male spline member 136 is to prevent relative circumferential rotation between the sliding assembly 55 and the barrel assembly 52.

In the exemplary embodiment shown, the male spline member 136 is comprised of at least two set screws 148 coupled with at least two ball elements 146. The at least two set screws 148 are attached to the upper sub 14 proximate its free end 118, and positioned contralateral in relation to the spline 130. Each set screw 148 retains at least one ball element 146, at least partially, within the spline 130. A purpose of the ball elements 146 is to allow for linear movement of the sliding assembly 55 in relation to the barrel assembly 52 along the spline 130. A further purpose of the coupling of the set screw 148 and ball element 146 combination with the spline 130 is to prevent relative circumferential rotation between the sliding assembly 55 and the barrel assembly 52.

The number of male spline members 136 utilized will be dependent in part on the amount of rotational force expected to be exerted on the drilling jar 10. It is understood that at least one male spline member 136 will be utilized.

At least one seal 138 is disposed proximate the free end 118 of the upper sub 14. A purpose for the at least one seal 138 is to prevent drilling mud and/or other material present in the area from entering into the tool through the free end 118 of the upper sub 14. The length of the spline 130 is not enclosed within the barrel assembly 52.

Figure 10:
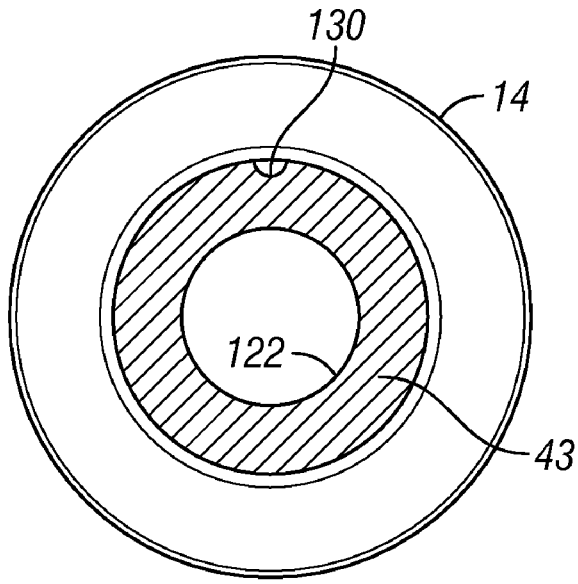
FIG. 10 is a cross-sectional view through plane A-A of FIGS. 1 and 13.

FIG. 10 is taken at cross-section A-A of FIG. 1. FIG. 10 depicts the groove of spline 130 in relation to the mandrel pipe 43.

Referring to FIGS. 1, 1A, 2, and 2A, the upper mandrel 12 is fixedly connected to knocker 16 by the interaction of external threading 42 on the mandrel 12 and internal threading 41 on the knocker 16. Knocker 16 is attached to wash pipe 22 by the interaction of internal threading 44 on the knocker 16 and external threading 45 on the wash pipe 22.

Upper sub 14 is fixedly connected to the upper barrel 18 by the interaction of external threading 47 on the upper sub 14 and the internal threading 46 on the upper barrel 18. Upper barrel 18 is fixedly connected to center sub 20 by the interaction of internal threading 51 on the upper barrel 18 and the external threading 50 on the center sub 20. Center sub 20 is fixedly connected to lower barrel 32 by the interaction of external threading 54 on center sub 20 and the internal threading 53 on the lower barrel 32. Lower barrel 32 is fixedly connected to lower sub 34 by interaction of internal threading 57 on the lower barrel 32 and the external threading 56 on the lower sub 34.

Sliding assembly 55 is slideably moveable in relation to barrel assembly 52. Mandrel pipe 43, of mandrel 12, and knocker 16 are slideable within upper sub 14 and upper barrel 18. Wash pipe 22 is slideable within upper barrel 18, center sub 20, lower barrel 32, and lower sub 34. In operation, such relative movement may be induced by raising or lowering of a drill string attached, either directly or indirectly, to upper mandrel 12. Alternatively, the weight of other drilling members and/or the drill string may be allowed to act upon the sliding assembly 55, and in turn the meter assembly 66, thereby tripping a downstroke.

As depicted in FIGS. 1 and 1A, the extent of relative upward movement of slide assembly 55 is limited. When the mandrel 12 is pulled upward, upper end 110 of knocker 16 abuts shoulder 112 of upper sub 14. In operation, the upward thrust of the jar, once tripped by the meter assembly 66, will cause the end 110 of the knocker 16 to forcefully collide with the shoulder 112 of the upper sub 14.

Figure 2A:
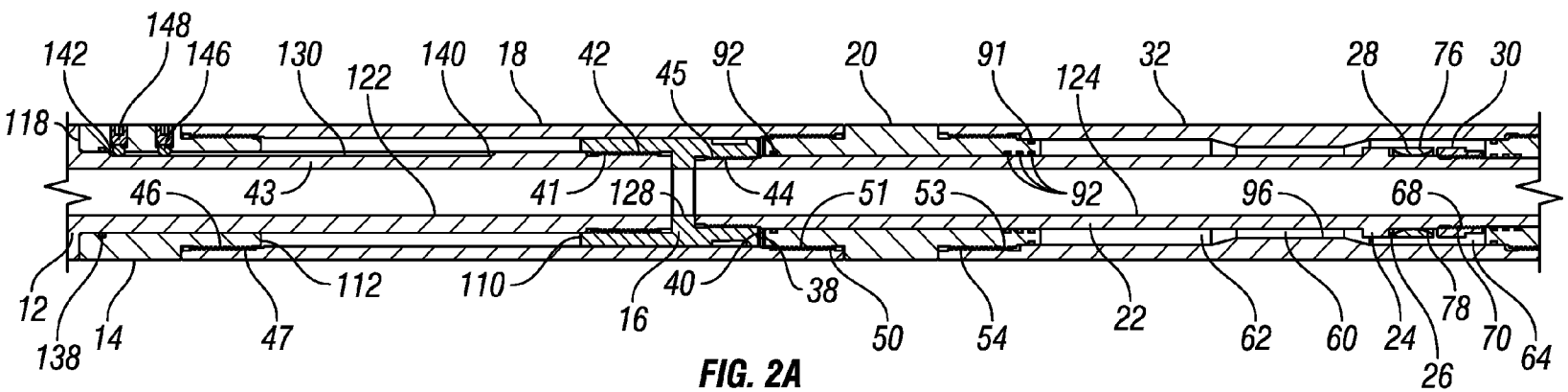
FIG. 2A is a detailed view of a portion of FIG. 2.

As depicted in FIGS. 2 and 2A, the extent of relative downward movement of slide assembly 55 is also limited. When the mandrel 12 is pushed downward, the lower end 38 of the knocker 16 abuts the shoulder 40 of the center sub 20. In operation, the downward thrust of the jar, once tripped by the meter assembly 66, will cause the lower end 38 of the knocker 16 to forcefully collide with the shoulder 40 of the center sub 20.

Still referring to FIGS. 1, 1A, 2 and 2A, lower barrel 32 comprises a hollow cylindrical structure having a restricted barrel segment 60. Restriction 60 comprises a segment of lower barrel 32 having a reduced interior wall diameter. The interior diameter of the lower barrel 32, outer diameter of the wash pipe 22, the lower end of the center sub 20, and the restriction 60 define the upper chamber 62. The interior diameter of the lower barrel 32, the outer diameter of the wash pipe 22, the upper end of the lower sub 34, and the restriction 60 define the lower chamber 64. Restriction 60 serves as the transition between the upper chamber 62 and lower chamber 64. Upper chamber 62 may be longer than the lower chamber 64. A reason for this discrepancy in length between the two chambers is the desire to shorten the travel length of the meter assembly 66 in the downstroke, and in turn the length of the stroke of the sliding assembly 55, to allow for greater control of the downstroke. A result of allowing greater control over the downstroke by shortening the lower chamber 64 in relation to the upper chamber 62 is the possible prevention of a spiraling or corkscrewing of the pipe during the down stroke.

The restriction 60 contains a smaller radial dimension than either the upper chamber 62 or lower chamber 64.

Inner seals 92 and outer seal 91 are provided above upper chamber 62 at the interface of center sub 20 with wash pipe 22. Outer seal 94 and inner seals 93 are provided below lower chamber 64 at the interface of lower sub 34 with wash pipe 22. Seals 92, 91, 93, and 94 effectively retain a quantity of fluid within upper chamber 62, restriction 60 and lower chamber 64 for acting on the meter assembly 66. The volume of fluid retained therein may be less than one hundred percent of the volume capable of being retained in the upper and lower chambers 62, 64 and the restriction 60.

Figure 6:
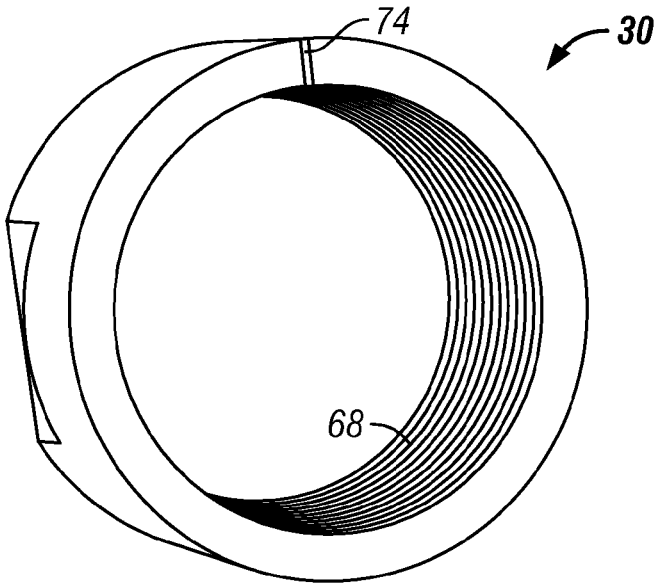
FIG. 6 is a perspective view of an embodiment of the lower flange.
Figure 7:
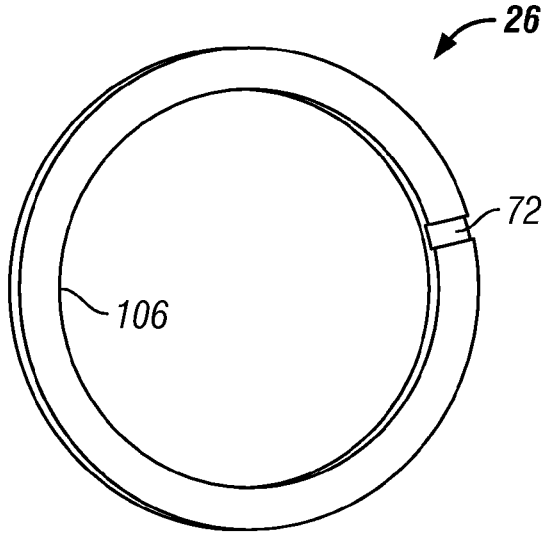
FIG. 7 is a perspective view of an embodiment of the meter ring.
Figure 8:
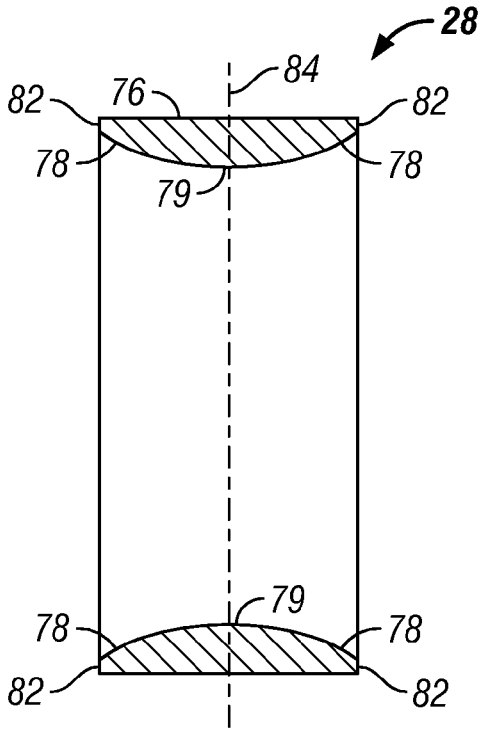
FIG. 8 is a cross-sectional view of an embodiment of the meter valve.

Referring to FIGS. 6-8, lower flange 30, shown in FIG. 6, comprises a generally cylindrical structure having internal threading 68 for fixed attachment to corresponding external threads 70 provided on the exterior of wash pipe 22. It is understood that the lower flange 30 may be affixed to the sliding assembly by any known means. Further, the lower flange 30 may be integrally attached to the sliding assembly. At least one opening 74 is provided in the lower flange 30. As shown, opening 74 extends completely across the upper contact surface of lower flange 30 whereby fluids from the inner diameter of lower flange 30 can flow across the opening 74 to the outer diameter.

A meter assembly 66 comprises a meter ring 26, a meter valve 28, a lower flange 30, an upper flange 24, and a restriction 60. Meter ring 26, shown in FIG. 7, comprises a generally annular structure sized to slideably fit about the exterior of wash pipe 22. At least one opening 72 is provided on meter ring 26. The meter ring 26 has an upper contact surface and an opposite lower contact surface. In the illustrated embodiment, the at least one opening 72 extends across either the upper or lower contact surface of the meter ring 26.

Meter valve 28, shown in FIG. 8 in cross-section, comprises a generally cylindrical structure sized to slideably fit about the exterior of wash pipe 22. The outside wall 76 of meter valve 28 is generally cylindrical. The inside wall 79 of meter valve 28 comprises at least one taper 78 at end 82. The taper 78 provides a thinner wall segment of meter valve 28 at the ends rather than at the center segment 79 of the meter valve 28. Upon applying pressure from the interior of meter valve 28, ends 82 are subject to greater expansion than center 84 due to differential wall thickness. Meter valve 28 is structured with dimensions and of a material that allows the taper 78 segments of meter valve 28 to expand at determined internal pressures. The amount of expansion depends at least on the internal temperature and pressure, the material of the meter valve 28, and/or the thickness of tapers 78. Both ends 82 of the meter valve 28 may be tapered 78.

In an exemplary embodiment, meter valve 28 may be constructed of brass. In an exemplary embodiment, the flare of the taper 78 may be approximately twenty degrees; through other flare ranges are well within the purview of the embodiments described herein.

The size and number of the openings 72 and 74 will vary depending upon the speed with which the fluid will move through the metering system in operation. The openings 72 and 74 on the meter ring 26 and the lower flange 30 need not be equal in width or length in relation to any of the other openings 72 and/or 74 of the meter ring 26 and/or the lower flange 30.

Figure 3:
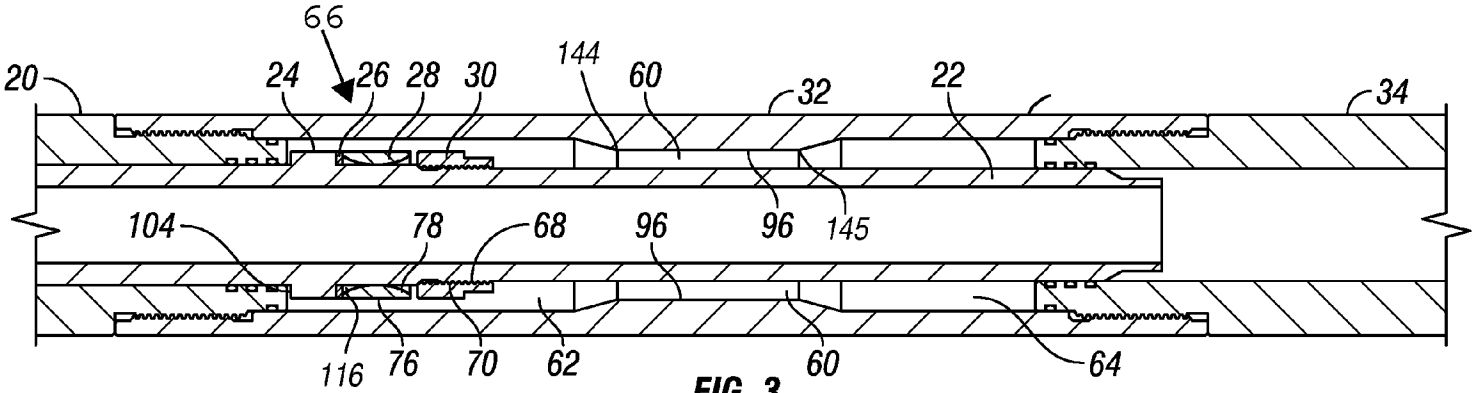
FIG. 3 is a cross-sectional view of an embodiment of a meter assembly of the drilling jar in an upstroke orientation.
Figure 5:
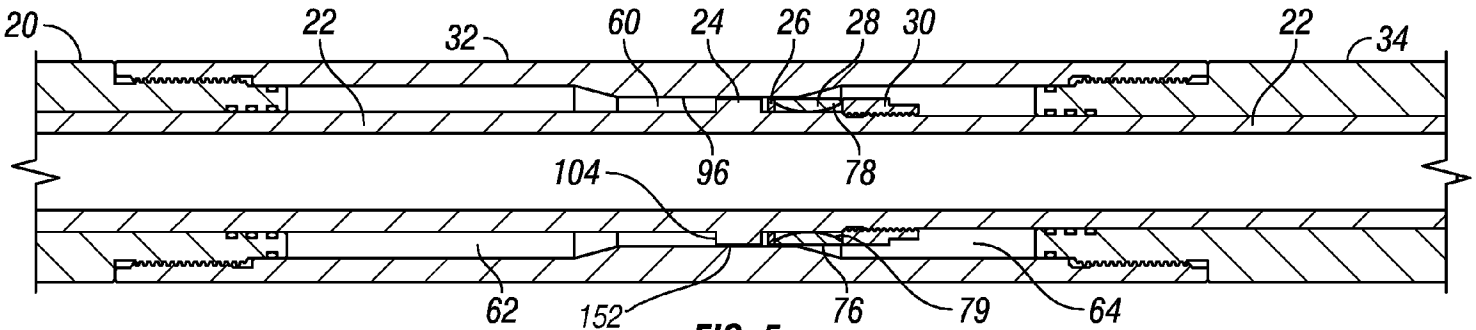
FIG. 5 is a cross-sectional view of the meter assembly at the beginning of an upstroke.

Referring to FIGS. 3-5, operation of the meter system 66 is depicted. FIG. 3 depicts the meter assembly 66 at an initial upstroke orientation. A volume of fluid (not shown) is retained in upper chamber 62, restriction 60, and lower chamber 64. This fluid may be a compressible fluid. Seals 91, 92, 93, and 94 prevent fluid leakage, as described above. Meter ring 26 and meter valve 28 are positioned about wash pipe 22 intermediate upper flange 24, and lower flange 30 within the upper chamber 62. The exterior diameters of meter ring 26, meter valve 28, upper flange 24, and lower flange 30 are each constructed to allow passage each of meter ring 26, meter valve 28, upper flange 24 and lower flange 30 through the restriction 60 in the lower barrel 32 to allow for movement between the upper 62 and lower 64 chambers.

FIG. 4 shows the meter assembly 66 as it first enters the restriction 60 upon downward movement of the sliding assembly 55 in relation to the barrel assembly 52. Lower flange 30 is pushed into restriction 60 resulting in pressure buildup in the lower chamber 64. The pressure buildup causes fluid flow into restriction 60, such flow being primarily directed to the interior 116 of the meter valve 28. As the pressure builds, the tapers 78 of the meter valve 28 expand directing more of the fluid within the lower chamber 64 to pass through the inner channel 116 of the meter valve 28. The tapers 78 may form an effective seal preventing substantial fluid to pass around the outer diameter of the meter valve 28 without preventing the travel of the meter valve 28 through the restriction 60. The differences in outer diameter of the meter valve 28 and the lower flange 30 may vary at least in part in relation to the inner diameter of the restriction 60.

The pressure increase further causes the meter ring 26 to abut the upper flange 24, and the meter valve 28 to abut the meter ring 26. Meter ring 26 and upper flange 24 are constructed to form a seal therebetween upon the exertion of pressure produced in the downstroke, such that fluid flow between the upper flange 24 and the meter ring 26 is substantially prevented. Meter ring 26 and meter valve 28 are constructed to form a seal between their contiguous surfaces thereby substantially preventing fluid flow between abutting surfaces of meter ring 26 and meter valve 28, notwithstanding the fluid flow through openings 72, upon the exertion of pressure produced in the downstroke.

At least one opening 72 is provided in the surface of meter ring 26 to allow for controlled fluid flow through the restriction 60. The size of opening 72 can be set at a predetermined size to control fluid flow through opening 72. Controlled flow through the at least one opening 72 allows pressure buildup to a determined level within lower chamber 64 and corresponding pressure reduction within upper chamber 62.

In an exemplary embodiment, the lower flange 30 contains a small circumferential gap 108 along its outer diameter to allow the fluid to flow therethrough in order to act upon the meter valve 28, meter ring 26, and upper flange 24. The outer surface 76 of the meter valve 28 conforms snuggly to the inner diameter 96 of the restriction 60 thereby effectively directing a majority of the fluid through the inner channel 116 of the meter valve 28. The alternative tapers 78 of the meter valve 28 may aid in providing a sufficient slideable seal between the meter valve 28 and the inner wall 96 of the restriction 60. Once the meter valve 28 of the meter assembly 66 passes the lower edge 145 of the restriction 60, the upper flange 24 and meter ring 26 will quickly follow, and the energy created during the metering process will be released. The energy created during the metering process will be transmitted to the sliding assembly 55 thereby causing a violent collision between corresponding impact surfaces 120, namely, the upper end 110 of the knocker 16 and the shoulder 40 of the center sub 20. Such impact force will be transmitted to the fishing tool or the like (not shown). The force may also result in a further impact force of the shoulder 114 of the mandrel 12 against the upper sub 14 and/or further impact of the lower end of lower flange 30 with the upper end of the lower sub 34.

A purpose of the meter ring 26 and the at least one opening 72 thereon is to create a pressure differential within the upper chamber 62 and the lower chamber 64 and to allow an amount of the fluid contained to slowly flow from the lower chamber 64 to the upper chamber 62. This flow of fluid allows the pressure in the lower chamber 64 to increase while allowing the upper flange 24 to move the meter assembly 66 through the restriction 60.

In this exemplary embodiment, the inner surface 96 of the restriction 60, and the meter valve 28, meter ring 26, and upper flange 24 combine to form a barrier to fluid flow in the upper direction. At least one release opening is formed within this barrier to allow controlled fluid flow in the upper direction.

FIG. 5 depicts the meter assembly 66 in preparation for an upstroke of the jar 10. The drill sting is stretched upward, or some other method is used, to pull the sliding assembly 55 upward thereby causing the meter assembly 66 to enter the restriction 60 and begin the upstroke process. Upper flange 24 is pushed into restriction 60. This results in pressure buildup in upper chamber 62 and pressure reduction in lower chamber 64. The pressure buildup causes fluid flow into restriction 60, such flow being primarily directed to the interior 116 of the meter valve 28. As the pressure builds, at lest one of the tapers 78 of the meter valve 28 expand directing more of the fluid within the upper chamber 62 to pass through the inner channel 116 of the meter valve 28. The tapers 78 may form an effective seal preventing substantial fluid to pass around the outer diameter of the meter valve 28 without preventing the travel of the meter valve 28 through the restriction 60. The differences in outer diameter of the meter valve 28 and the upper flange 24 may vary at least in part to the inner diameter of the restriction 60.

The pressure increase causes the meter valve 28 to abut the lower flange 30. Meter valve 28 and lower flange 30 are constructed to form a seal therebetween upon the exertion of pressure produced in the upstroke, such that fluid flow between the contiguous surfaces of the meter valve 28 and the lower flange 30, notwithstanding the fluid flow through openings 74, is substantially prevented. The resulting pressure further substantially prevents the fluid flow between the abutting surfaces of the meter ring 26 and the meter valve 28.

At least one opening 74 is provided in the surface of lower flange 30 to allow for controlled fluid flow through the restriction 60. The size of openings 74 can be set at a predetermined size to control fluid flow through opening 74. Controlled flow through the at least one opening 74 allows pressure buildup within upper chamber 62 and corresponding pressure reduction within lower chamber 64.

In the embodiment shown, the upper flange 24 contains a small circumferential gap 152 along its outer diameter, larger than the annular area existing between the meter valve 28 and the interior wall of the restriction 60, to allow the fluid to flow therethrough in order to act upon the meter valve 28 and lower flange 30. The outer surface 76 of the meter valve 28 conforms snuggly to the inner diameter 96 of the restriction 60 thereby effectively directing a majority of the fluid through the inner channel 116 of the meter valve 28. The alternative tapers 78 of the meter valve 28 may aid in providing a sufficient slideable seal between the meter valve 28 and the inner wall 96 of the restriction 60. Once the meter valve 28 of the meter assembly 66 passes the upper edge 144 of the restriction 60, the lower flange 30 will quickly follow, and the energy created during the metering process will be released. The energy created during the metering process will be transmitted to the sliding assembly 55 thereby causing a violent collision between corresponding impact surfaces 120, namely, the upper end 110 of the knocker 16 and the shoulder 112 of the upper sub 14. Such impact force will be transmitted to the fishing tool or the like (not shown). The force may also result in a further impact force of the upper surface 104 of the upper flange 24 against the center sub 20.

A purpose of the lower flange 30 and the at least one opening 74 is to create a pressure differential within the upper chamber 62 and the lower chamber 64, and to allow an amount of fluid contained therein to slowly flow from the upper chamber 62 to the lower chamber 64. This fluid flow allows the pressure in the upper chamber 62 to increase while allowing the lower flange 30 to move the upstroke meter assembly 167 through the restriction 60.

In this exemplary embodiment, the inner surface 96 of the restriction 60, and the meter ring 26, meter valve 28 and lower flange 30 combine to form a barrier to fluid flow in the downward direction. At least one release opening is formed within this barrier to allow controlled fluid flow in the lower direction.

The jar 10 may be operated in one direction alone as needed, without the need to perform the opposite stroke in order to reset the system. In relation to the downstroke, a second and/or subsequent down-stoke may be triggered by pulling on the drill string in order to place the meter assembly 66 proximate the lower edge 145 of the restriction 60. Compression of the drill string will occur to trigger the downstroke and the meter assembly 66 will travel the shortened length necessary to produce the downstroke. This may be repeated as often as is desired.

Similarly, in relation to the upstroke, a second and/or subsequent upstroke may be triggered by placing linear, downward pressure on the mandrel 12 at its upper end 36 in order to place the meter assembly 66 proximate the upper edge 144 of the restriction 60. Elongation of the drill string in the upper direction will trigger the upstroke as the meter assembly 66 will travel the length of the upper chamber 62 to produce the upstroke. This process may be repeated as often as desired.

Referring to FIGS. 1, 1A, 2 and 2A, mandrel 12 has an internal elongated substantially cylindrical wall 122, knocker 16 has an internal, substantially cylindrical wall 128, wash pipe 22 has an internal elongated substantially cylindrical wall 124 and lower sub 34 has an interior elongated substantially cylindrical wall 126. Cylindrical walls 122, 128, 124, and 126 are each constructed with a diameter sufficient to allow fluid to pass therethrough. Further, cylindrical walls 122, 128, 124, and 126 are each constructed with a diameter sufficient to allow the passage of a sealing ball (not shown) through mandrel 12, knocker 16, wash pipe 22 and lower sub 34 for operation of a hydraulic disconnect. Accordingly, the drilling jar 10 of the present invention may be placed above a hydraulic disconnect on the drill string.

Referring to FIGS. 13, 13A, 14, and 14A, operation of an alternative embodiment of the meter system 166 is depicted. Regarding FIGS. 13 and 13A, a volume of fluid (not shown) is retained in upper chamber 62, restriction 60, and lower chamber 64. Seals 91, 92, 93, and 94 prevent fluid leakage, as described above. Meter valve 28 is positioned about wash pipe 22 intermediate upper flange 24 and lower flange 30 within the upper chamber 62. The exterior diameters of the meter valve 28, upper flange 24, and lower flange 30 are each constructed to allow passage each of meter valve 28, upper flange 24 and lower flange 30 through the restriction 60 in the lower barrel 32 to allow for movement between the upper 62 and lower 64 chambers.

Preparation for a downstroke involves manipulating the metering assembly 166 to enter the restriction 60 from the upper chamber 62. Lower flange 30 is pushed into restriction 60 resulting in pressure buildup in the lower chamber 64. The pressure buildup causes fluid flow into restriction 60, such flow being primarily directed to the interior 116 of the meter valve 28. As the pressure builds, the tapers 78 of the meter valve 28 expand directing more of the fluid within the lower chamber 64 to pass through the inner channel 116 of the meter valve 28. The tapers 78 may form an effective seal preventing substantial fluid to pass around the outer diameter the meter valve 28 without preventing the travel of the meter valve 28 through the restriction 60. The differences in outer diameter of the meter valve 28 and the lower flange 30 may vary at least in part in relation to the inner diameter of the restriction 60.

The pressure increase further causes the meter valve 28 to abut the upper flange 24. Upper flange 24 and meter valve 28 are constructed to form a seal between their contiguous surfaces thereby substantially preventing fluid flow within the junction upon the exertion of pressure produced in the downstroke.

At least one opening 73 is provided in the surface of upper flange 24 to allow for controlled fluid flow through the restriction 60. The size of the opening 73 can be set at a predetermined size to control fluid flow through the restriction 60. Controlled flow through the at least one opening 73 allows pressure buildup to a determined level within lower chamber 64 and corresponding pressure reduction within upper chamber 62.

The lower flange 30 may contain a small circumferential gap 108 along its outer diameter to allow the fluid to flow therethrough in order to act upon the meter valve 28 and upper flange 24. The outer surface 76 of the meter valve 28 conforms snuggly to the inner diameter 96 of the restriction 60 thereby effectively directing a majority of the fluid through the inner channel 116 of the meter valve 28. Once the meter valve 28 of the meter assembly 166 passes the lower edge 145 of the restriction 60, the upper flange 24 will quickly follow and the energy created during the metering process will be released. The energy created during the metering process will be transmitted to the sliding assembly 55 thereby causing a violent collision between corresponding impact surfaces 120, namely, the upper end 110 of the knocker 16 and the shoulder 40 of the center sub 20. Such impact force will be transmitted to the fishing tool or the like (not shown). The force may also result in a further impact force of shoulder 114 of the mandrel 12 against the upper sub 14 and/or further impact of the lower end of lower flange 30 with the upper end of the lower sub 34.

A purpose of the upper flange 24 and the at least one opening 73 thereon is to create a pressure differential within the upper chamber 62 and the lower chamber 64 and to allow an amount of the fluid contained to slowly flow from the lower chamber 64 to the upper chamber 62. This flow of fluid allows the pressure in the lower chamber 64 to increase while allowing the upper flange 24 to move the meter assembly 66 through the restriction 60.

In this exemplary embodiment, the inner surface 96 of the restriction 60, and the meter valve 28 and upper flange 24 combine to form a barrier to fluid flow in the upper direction. At least one release opening is formed within this barrier to allow controlled fluid flow in the upper direction.

Figure 14:
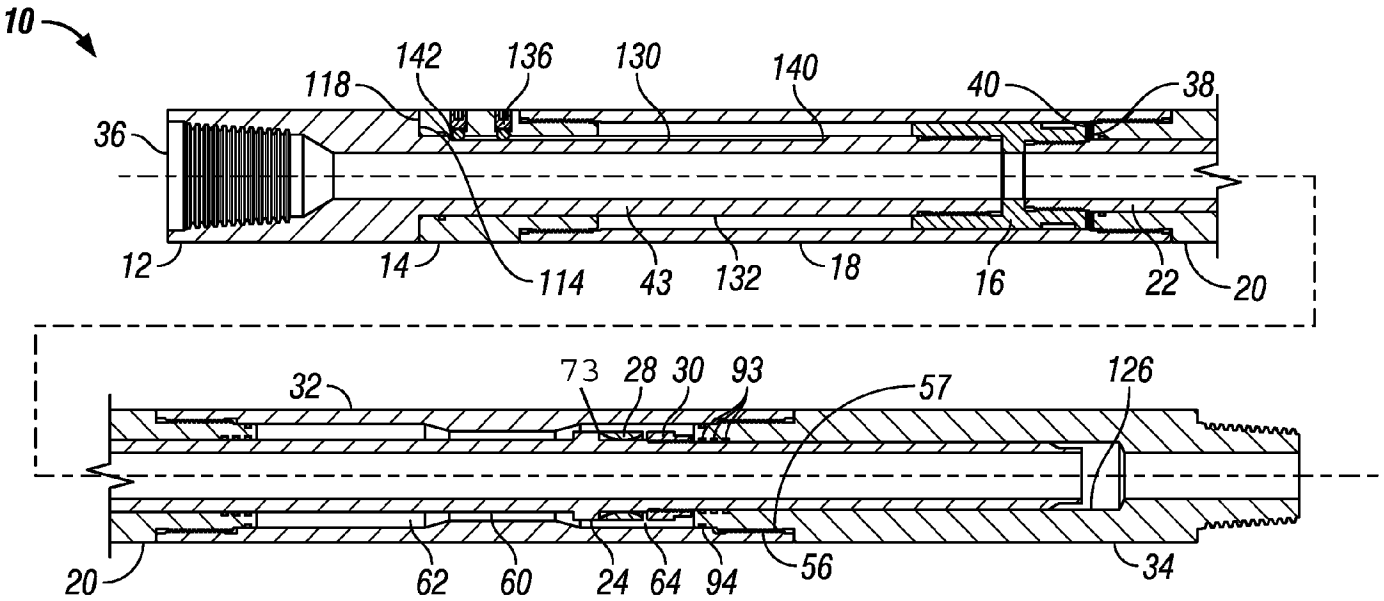
FIG. 14 is a cross-sectional view of an alternative embodiment of the metering assembly in a downstroke orientation.
Figure 14A:
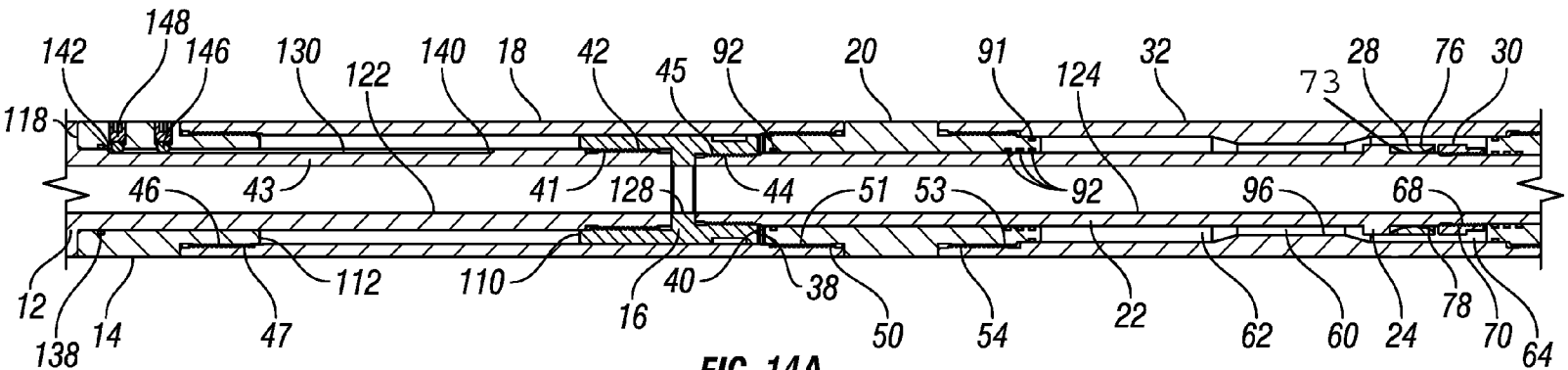
FIG. 14A is a detailed view of a portion of the metering assembly of FIG. 14.

Referring to FIGS. 14 and 14A, reparation for an upstroke involves manipulating the metering assembly 166 to enter the restriction 60 from the lower chamber 62. The drill sting is stretched upward, or some other method is used, to pull the sliding assembly 55 upward thereby causing the meter assembly 166 to enter the restriction 60 and begin the upstroke process. Upper flange 24 is pushed into the restriction 60. This results in pressure buildup in upper chamber 62 and pressure reduction in lower chamber 64. The pressure buildup causes fluid flow into restriction 60, such flow being primarily directed to the interior 116 of the meter valve 28. As the pressure builds, the tapers 78 of the meter valve 28 expand directing more of the fluid within the upper chamber 62 to pass through the inner channel 116 of the meter valve 28. The tapers 78 may form an effective seal preventing substantial fluid to pass around the outer diameter the meter valve 28 without preventing the travel of the meter valve 28 through the restriction 60. The differences in outer diameter of the meter valve 28 and the upper flange 24 may vary at least in part to the inner diameter of the restriction 60.

The pressure increase causes the meter valve 28 to abut the lower flange 30. Meter valve 28 and lower flange 30 are constructed to form a seal therebetween upon the exertion of pressure produced in the upstroke, such that fluid flow between the contiguous surfaces of the meter valve 28 and the lower flange 30 is substantially prevented.

At least one opening 74 is provided in the surface of lower flange 30 to allow for controlled fluid flow through the restriction 60. The size of opening 74 can be set at a predetermined size to control fluid flow through opening 74. Controlled flow through the at least one opening 74 allows pressure buildup within upper chamber 62 and corresponding pressure reduction within lower chamber 64.

The upper flange 24 may contain a small circumferential gap 152 along its outer diameter, larger than the annular area existing between the meter valve 28 and the interior wall of the restriction 60, to allow the fluid to flow therethrough in order to act upon the meter valve 28 and lower flange 30. The outer surface 76 of the meter valve 28 conforms snuggly to the inner diameter 96 of the restriction 60 thereby effectively directing a majority of the fluid through the inner channel 116 of the meter valve 28. Once the meter valve 28 of the meter assembly 166 passes the upper edge 144 of the restriction 60, the lower flange 30 will quickly follow, and the energy created during the metering process will be released. The energy created during the metering process will be transmitted to the sliding assembly 55 thereby causing a violent collision between corresponding impact surfaces 120, namely, the upper end 110 of the knocker 16 and the shoulder 112 of the upper sub 14. Such impact force will be transmitted to the fishing tool or the like (not shown). The force may also result in a further impact force of the upper surface 104 of the upper flange 24 against the center sub 20.

A purpose of the lower flange 30 and the at least one opening 74 is to create a pressure differential within the upper chamber 62 and the lower chamber 64, and to allow an amount of fluid contained therein to slowly flow from the upper chamber 62 to the lower chamber 64. This fluid flow allows the pressure in the upper chamber 62 to increase while allowing the lower flange 30 to move the meter assembly 166 through the restriction 60.

In this exemplary embodiment, the inner surface 96 of the restriction 60, and the meter valve 28 and lower flange 30 combine to form a barrier to fluid flow in the downward direction. At least one release opening is formed within this barrier to allow controlled fluid flow in the lower direction.

In an alternative embodiment the spline 130 is in the form of a protrusion from the mandrel pipe 43. Female spline members interact with the spline 130 to provide the necessary interconnection between the two. The protrusion may be integral to the mandrel pipe 43. Alternatively, the spline 130 may be attached to the mandrel pipe 43 by welding or the like.

In an alternative embodiment, the restriction 60 is provided proximate the linear center of the lower barrel 32. Alternatively, the lower chamber 64 may be larger than the upper chamber 62. Alternatively, the restriction 60 may be located in a position that will produce the stroke and/or metering effect.

Figure 9:
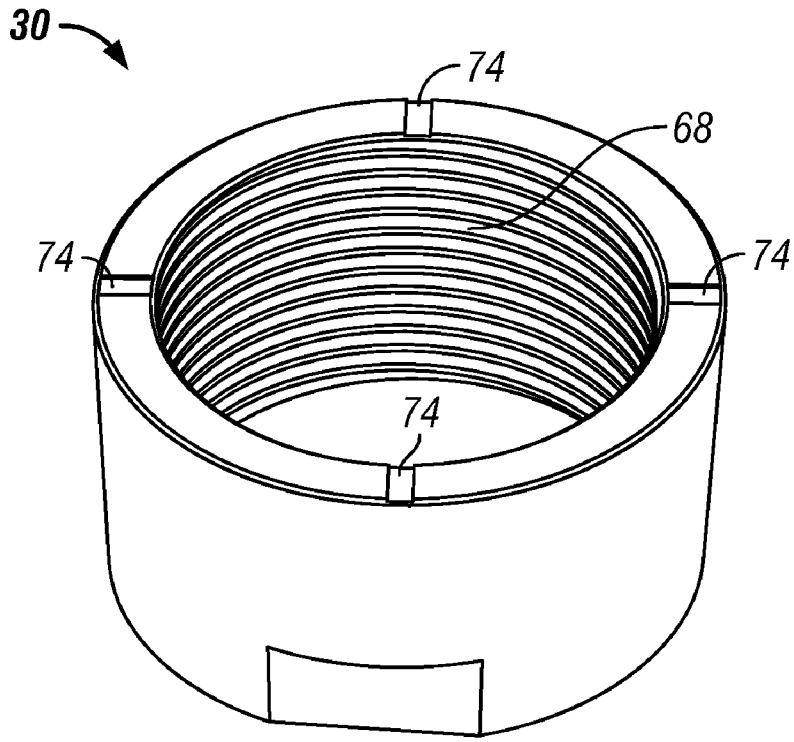
FIG. 9 is a perspective view of an alternative embodiment of the lower flange.

The openings 72, 73, 74 can limit the amount of fluid that is allowed through the restriction 60. In an alternative embodiment, a plurality of openings 72 may be utilized on a surface of the meter ring 26. The openings 72 may be of the same and/or of differing widths and/or sizes, or a combination depending on the desired effect. In an alternative embodiment, a plurality of openings 73 may be utilized on a surface of the upper flange 24. The openings 72 may be of the same and/or of differing widths and/or sizes, or a combination depending on the desired effect. In a further alternative embodiment, a plurality of openings 74 may be utilized on a surface of the lower flange 30, see FIG. 9. The openings 74 may be of the same and/or of differing widths and/or sizes, or a combination depending on the desired effect. In another alternative embodiment, both the meter ring 26 and the lower flange 30 may contain a plurality of openings 72 and 74 of the same or differing sizes and/or widths. In a further alternative embodiment, both the upper flange 24 and the lower flange 30 may contain a plurality of openings 73 and 74 of the same or differing sizes and/or widths.

The openings 72, 73, 74 may comprise notches, grooves, indentations, scores, dents, and the like. Alternatively the openings 72, 73, 74 transverse across the surface and/or through a portion of the body of the meter ring 26, upper flange 24, and/or lower flange 30, respectfully. Alternatively the openings 72, 73, 74 are vertical through the length of the meter ring 26, upper flange 24, and/or lower flange 30, respectively. Alternatively, the openings 72, 73, 74 are a combination of transverse and vertical openings with respect to the meter ring 26, upper flange 24, and/or lower flange 30.

In an alternative embodiment, a meter ring 26 may be utilized with the metering assembly 166 containing an opening 73 on the upper flange 24. The meter ring 26 may contain at least one opening 72 providing fluid flow to or from the meter valve 28, or, alternatively, providing increased fluid flow between the meter ring 26 and upper flange 24. The size of the at least one opening 72, 73 and/or 74 can be set at a predetermined size to control fluid flow through the opening. A plurality of openings 72, 73, and/or 74 may be employed, of equal or varying sizes and/or widths.

In a further alternative embodiment, at least one opening may be provided in the wall 76 of the meter valve 28. The meter valve 28 may be sealed at either one or both ends to prevent fluid flow, thereby forcing fluid flow through the at least one opening in order to meter the system. Tapers 78 may be used as needed to seal one or both ends 82 of the meter valve 28.

Flow through the openings 74, 73, and/or 72 may further be controlled through the use of the fluid medium. A more viscous fluid will allow for slower passage through the meter assembly 66, 166 whereas a less viscous fluid will allow for faster passage.

In the exemplary embodiment, the at least one opening 72 of the meter ring 26 is disposed across the sealing face of the meter ring 26 that lies contiguous with the sealing face of the meter valve 28.

In an exemplary embodiment, the at least one opening 74 of the lower flange 30 is disposed across the sealing face of the lower flange 30 that lies contiguous with the face of the meter valve 28.

In a further exemplary embodiment, the at least one opening 73 of the upper flange 24 is disposed across the sealing face of the upper flange 24 that lies contiguous with the face of the meter valve 28.

In an alternative embodiment at least one hole of a predetermined size is formed through the wall of meter ring 26 near the liner center of meter ring 26. This embodiment is only possible if meter ring 26 is of sufficient width in the longitudinal direction to allow the forming of a hole in the wall.

In an alternate exemplary embodiment of the present invention, meter valve 28 does not contain tapers 78, but is constructed with a wall thickness that allows the entire wall to expand and contract at predetermined temperature and pressure conditions.

In an alternative embodiment, the meter ring 26 contains a small circumferential gap 150 along its outer diameter to allow the fluid past. Some fluid may flow through opening 72 towards the interior surface 106. Alternatively and/or in combination, the taper 78 of the meter valve 28 will direct the fluid passing either through the opening 72, around the meter ring 26, or through the interior cavity of the meter ring 26 to the interior channel 116 of the meter valve 28.

Alternatively, the meter ring 26 may fit snuggly within the restriction 60 forming a sufficient seal there round. The fluid is then directed towards the interior channel 116 of the meter valve 28 through the opening 72 and/or through the interior cavity of the meter ring 26.

Figure 11:
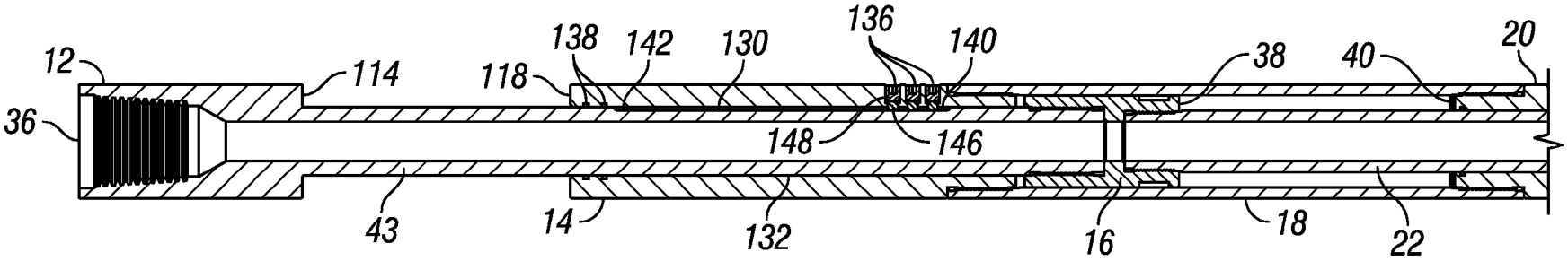
FIG. 11 is a cross-sectional view of an alternative embodiment of the drilling jar in an upstroke orientation.
Figure 12:
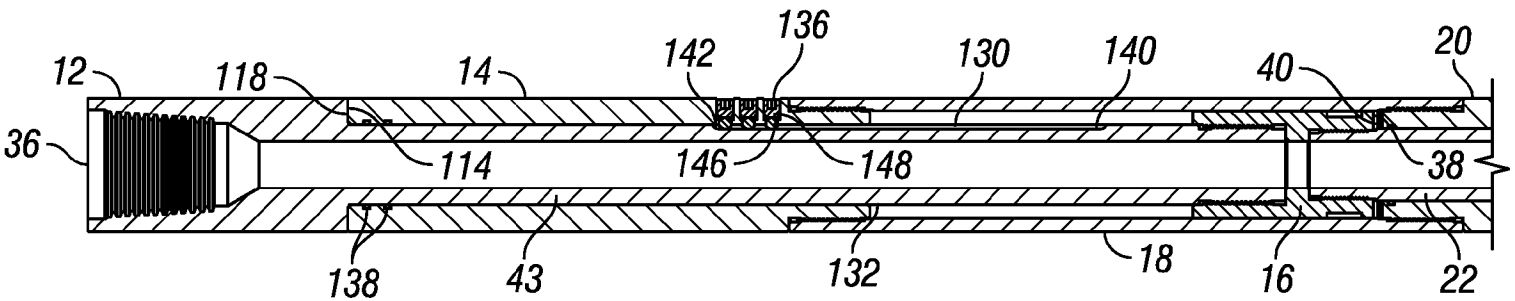
FIG. 12 is a cross-sectional view of an alternative embodiment of the drilling jar in a downstroke orientation.
Figure 13:
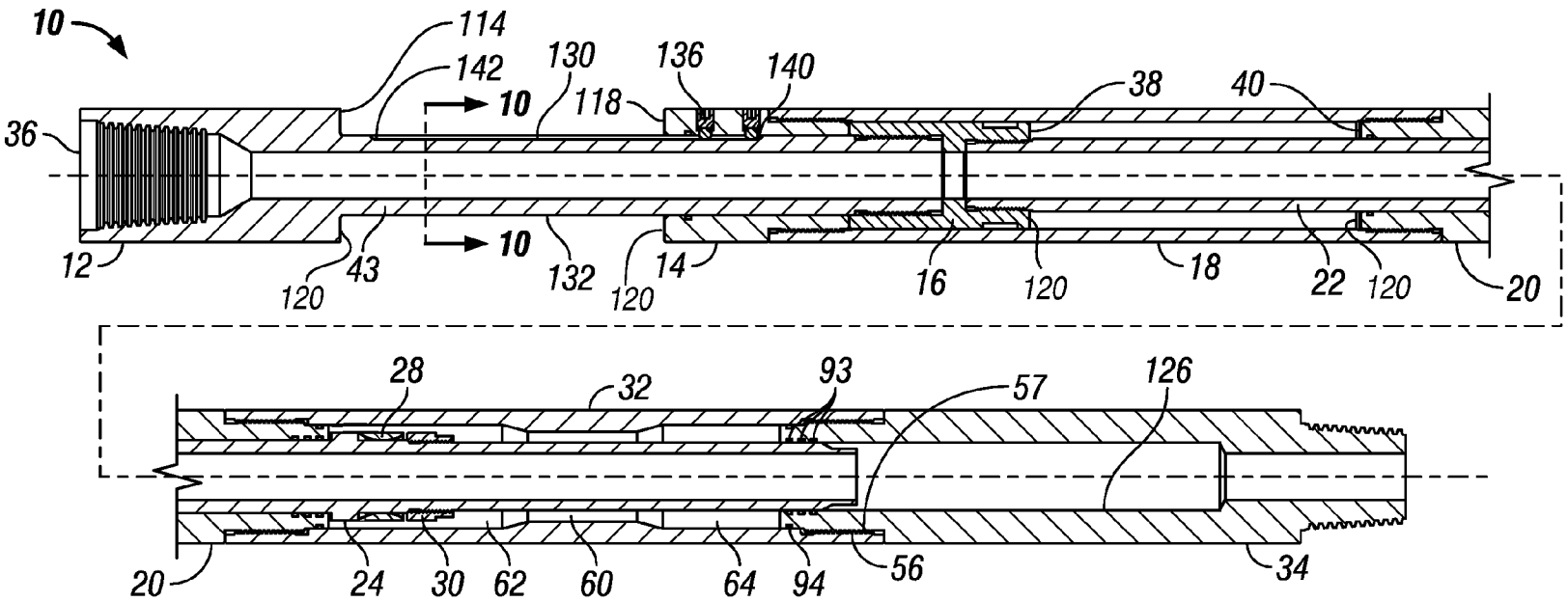
FIG. 13 is a cross-sectional view of an alternative embodiment of the metering assembly in an upstroke orientation.
Figure 13A:
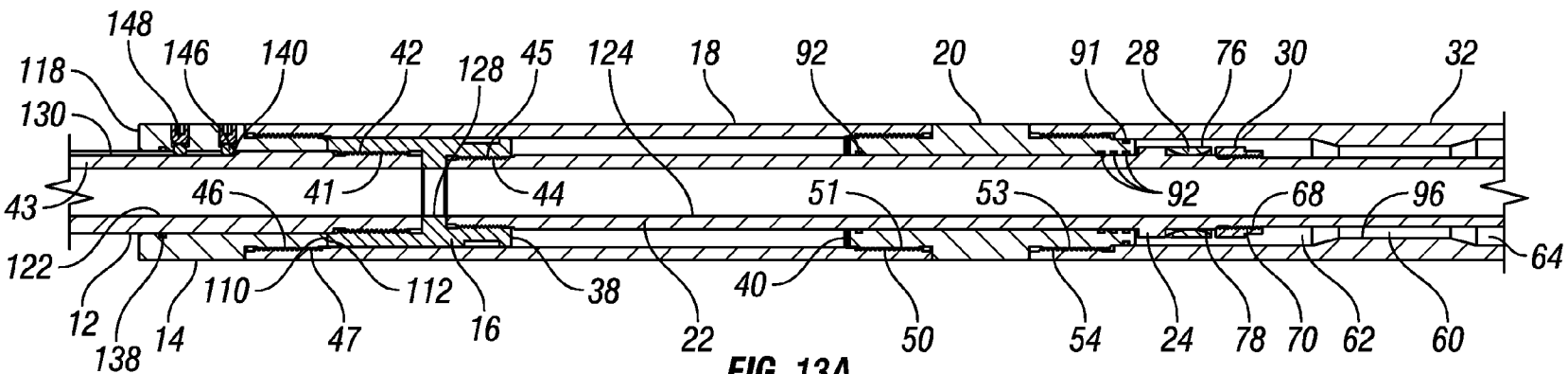
FIG. 13A is a detailed view of a portion of the drilling jar of FIG. 13.

FIGS. 11 and 12 show an alternative embodiment of the upper end of the drilling jar 10 wherein at least one spline 130 is substantially sealed within at least the upper sub 14. The mandrel pipe 43 is elongated to accommodate the enclosure of the spline 130 while still retaining sufficient length to provide an adequate up jar and/or down jar stroke. A purpose for the lengthening of the mandrel pipe 43 is to allow for the enclosure of the spline 130 while still allowing for an adequate downstroke and/or upstroke of the jar 10.

Likewise, the upper sub 14 is elongated to accommodate the length of the spline 130 while allowing for a sufficient distance between its free end 118 and the shoulder 114 of the mandrel 12 for a sufficient up and/or down stroke. A purpose for the lengthening of the upper sub 14 is to enclose the section of the mandrel pipe 43 containing the spline 130.

The spline 130 extends longitudinally along at least part of the mandrel pipe 43. The spline 130 does not extend past the free end 118 of the upper sub 14 when the sliding assembly 55 is disposed in its fully extended upstroke position with the free end 118 of the upper sub 14 disposed distal the shoulder 114 of the upper mandrel 12. At least one corresponding male spline member 136 is disposed distal the free end 118 of the upper sub 14 such that the male spline member 136 engages the spline 130. The male spline member 136 is movable between a first position 140 and a second position 142 along the spline 130 as necessary for proper operation of the drilling jar 10.

The free end 118 of the upper sub 14 is sealed by at least one seal 138. A purpose of the seal is to prevent drilling mud and/or other material present in the area from entering the upper sub 14. A purpose of the sealed spline 130 is to prevent the drilling mud and/or other material located in the area from interfering with the action and purpose of the jar 10 by clogging the spline 130 and/or entering the upper sub 14 though the slight opening that is created between the spline 130 and the male spine member 136 which in turn may prevent the jar 10 from functioning properly.

In an exemplary embodiment, the length of the drilling jar 10 is approximately 124.5 cm (49 inches), with an upstroke and downstroke equal to approximately 106.7 cm (3.5 feet). A crane is not necessary in order to deploy the drilling jar 10.

Various changes or modifications may be made to the disclosed embodiments without departing from the true spirit and scope of the invention as contained within the scope of the appended claims. It is understood that the invention is only limited by the claims and their equivalents.

What is claimed is:

1. A metering assembly for a drilling jar comprising a sliding assembly slideable within a barrel assembly, said barrel assembly having a restricted barrel segment defining an upper chamber and a lower chamber, a volume of fluid retained in said upper chamber, said lower chamber, and said restricted barrel segment;

said metering assembly comprising:

an upper flange;

a lower flange;

a meter valve slideable between said upper flange and said lower flange;

said upper flange, said lower flange, and said meter valve constructed to slide through said restricted barrel segment;

at least one upper opening provided in said upper flange, wherein at least one of said at least one upper opening is constructed to allow fluid to flow there through;

at least one lower opening provided in said lower flange, wherein at least one of said at least one lower opening is constructed to allow fluid to flow there through;

wherein said upper chamber is larger than said lower chamber; and wherein said fluid retained in said upper chamber, restricted barrel segment, and lower chamber is compressible fluid.

2. The metering assembly of claim 1, wherein said meter valve contains an upper end and an opposite lower end; and said at least one of said upper end or said lower end are tapered.

3. The metering assembly of claim 2, further comprising:

said upper flange having an upper surface and an opposite contact surface;

said at least one upper opening traversing at least a portion of said contact surface of said upper flange; and wherein said upper end and said lower end of said meter valve are tapered.

4. The metering assembly of claim 1, further comprising:

a plurality of upper openings provided in said upper flange; and wherein said upper flange is integrally connected to said sliding assembly.

5. The metering assembly of claim 4, further comprising:

at least one seal proximate said upper chamber and at least one seal proximate said lower chamber, said seals retaining said fluid within said upper chamber, said restricted barrel segment, and said lower chamber; and wherein at least two of said upper openings are of varying sizes.

6. The metering assembly of claim 1, further comprising:

a plurality of lower openings provided in said lower flange; and wherein said lower flange is threadedly connected to said sliding assembly.

7. The metering assembly of claim 6, wherein at least two of said lower openings are of varying sizes; and wherein said lower chamber is larger than said upper chamber.

8. The metering assembly of claim 1, further comprising:

said lower flange having a circumferential gap between the outer diameter of said lower flange and the inner diameter of said restricted barrel segment;

said lower flange having a lower surface and a contact surface; and said at least one lower opening traversing at least a portion of said contact surface of said lower flange.

9. The metering assembly of claim 1, further comprising:

said upper flange having a circumferential gap between the outer diameter of said upper flange and the inner diameter of said restricted barrel segment; and wherein said meter valve is brass.

10. A metering assembly for a drilling jar comprising a sliding assembly slideable within a barrel assembly, said barrel assembly having a restricted barrel segment defining an upper chamber and a lower chamber, a volume of fluid retained in said upper chamber, said lower chamber, and said restricted barrel segment; said metering assembly comprising:

an upper flange;

a lower flange;

a meter valve adjacent to a meter ring, both said meter valve and said meter ring slideable between said upper flange and said lower flange;

said upper flange, said lower flange, said meter valve, and said meter ring constructed to slide through said restricted barrel segment;

at least one upper opening provided in said meter ring, wherein at least one of said at least one upper opening is constructed to allow fluid to flow there through; and at least one lower opening provided in said lower flange, wherein at least one of said at least one lower opening is constructed to allow fluid to flow there through.

11. The metering assembly of claim 10, wherein:

said meter valve contains an upper end and an opposite lower end; said at least one of said upper end or said lower end are tapered;

said lower flange having a lower surface and a contact surface;

said at least one lower opening traversing at least a portion of said contact surface of said lower flange;

said meter ring having an upper contact surface and an opposite lower contact surface; and said at least one upper opening traversing at least a portion of said upper or lower contact surface.

12. The metering assembly of claim 11, wherein:

said upper end and said lower end of said meter valve are tapered;

wherein said upper flange is integrally connected to said sliding assembly; and wherein said lower flange is threadedly connected to said sliding assembly.

13. The metering assembly of claim 10, further comprising:

said lower flange having a circumferential gap between the outer diameter of said lower flange and the inner diameter of said restricted barrel segment; and said upper flange having a circumferential gap between the outer diameter of said upper flange and the inner diameter of said restricted barrel segment.

14. The metering assembly of claim 13, further comprising:

said meter ring having a circumferential gap between the outer diameter of said meter ring and the inner diameter of said restricted barrel segment;

a plurality of upper openings provided in said meter ring; and a plurality of lower openings provided in said lower flange.

15. The metering assembly of claim 10, wherein:

said upper chamber is larger than said lower chamber; and wherein said meter valve is brass.

16. A drilling jar apparatus, comprising:

a barrel assembly;

a sliding assembly;

said sliding assembly positioned in sliding relation to the interior of said barrel assembly;

at least one set of corresponding impact surfaces located on said barrel assembly and said sliding assembly;

said barrel assembly having a restricted barrel segment defining an upper chamber and a lower chamber;

a volume of fluid retained in said upper chamber, said lower chamber, and said restricted barrel segment;

a metering assembly comprising:

an upper flange;

a lower flange;

a meter valve;

a meter ring;

said meter valve intermediate said meter ring and said lower flange;

both said meter valve and said meter ring slideable between said upper flange and said lower flange;

said upper flange, said lower flange, said meter valve, and said meter ring constructed to slide through said restricted barrel segment;

at least one upper opening provided in said meter ring, wherein at least one of said at least one upper opening is constructed to allow fluid to flow there through;

at least one lower opening provided in said lower flange, wherein at least one of said at least one lower opening is constructed to allow fluid to flow there through; and wherein said meter valve contains an upper end and an opposite lower end; wherein said upper end and said lower end are tapered.

17. The metering assembly of claim 16, wherein said sliding assembly further comprises a mandrel having at least one spline thereon;

said barrel assembly further comprising an upper sub having at least one male spline member therein;

wherein said male spline member is functionally connected to said spline;

said lower flange having a lower surface and a contact surface;

said at least one lower opening traversing at least a portion of said contact surface of said lower flange;

said meter ring having an upper contact surface and an opposite lower contact surface;

said at least one upper opening traversing at least a portion of said lower contact surface.

18. The metering assembly of claim 17, wherein said mandrel extends from a first closed position to an second fully extended position, wherein said upper sub envelopes the whole of said spline in said second fully extended position.

19. The metering assembly of claim 16, further comprising:

said lower flange having a lower surface and a contact surface;

said at least one upper opening traversing at least a portion of said contact surface of said lower flange;

said meter ring having an upper contact surface and an opposite lower contact surface;

said at least one upper opening traversing at least a portion of said upper or lower contact surface;

said lower flange having a circumferential gap between the outer diameter of said lower flange and the inner diameter of said restricted barrel segment;

said upper flange having a circumferential gap between the outer diameter of said upper flange and the inner diameter of said restricted barrel segment;

said meter ring having a circumferential gap between the outer diameter of said meter ring and the inner diameter of said restricted barrel segment; and wherein said upper chamber is larger than said lower chamber.

* * * * *